US005167284A

United States Patent [19]

Leismer

[11] Patent Number: 5,167,284

[45] Date of Patent: Dec. 1, 1992

[54] SELECTIVE HYDRAULIC LOCK-OUT WELL SAFETY VALVE AND METHOD

[75] Inventor: Dwayne D. Leismer, Pearland, Tex.

[73] Assignee: Camco International Inc., Houston, Tex.

[21] Appl. No.: 732,370

[22] Filed: Jul. 18, 1991

[51] Int. Cl.[5] ..... E21B 43/12

[52] U.S. Cl. ..... 166/374; 166/323

[58] Field of Search ..... 166/373, 374, 375, 321, 166/322, 323, 326

[56] References Cited

U.S. PATENT DOCUMENTS 3,786,865 1/1974 Tausch et al. ..... 166/323
4,062,406 12/1977 Akkerman et al. ..... 166/323
4,215,748 8/1980 Pace et al. ..... 166/323 X
4,273,194 6/1981 Pringle et al. ..... 166/323
4,624,315 11/1986 Dickson et al. ..... 166/375 X
4,796,705 1/1989 Carmody et al. ..... 166/323

*Primary Examiner*—William P. Neuder
*Attorney, Agent, or Firm*—Fulbright & Jaworski

[57] ABSTRACT

A hydraulically actuated subsurface well safety valve having a first hydraulic piston and cylinder assembly for normally actuating a flow tube and controlling the opening and closing of the valve. A second lock-out piston and cylinder assembly is provided for holding the valve in the open position and a hydraulically actuated release mechanism engages the lock-out for releasing the lock-out and allowing the valve to close. A releasable and engagable latch mechanism in the second assembly releasably holds the second assembly inactive but can be overcome and reengaged for multiple operations.

15 Claims, 7 Drawing Sheets 26
26
22
14
12

SELECTIVE HYDRAULIC LOCK-OUT WELL SAFETY VALVE AND METHOD

BACKGROUND OF THE INVENTION

During the life of a surface controlled subsurface well safety valve it may become necessary to lock the valve in the open position. Typically, this is done by conventional wireline methods. However, a hydraulic lock-out mechanism can be utilized as disclosed in U.S. Pat. Nos. 4,273,194 and 4,796,705 when wireline methods are not used. The hydraulic lock-out is performed by applying hydraulic pressure to a dedicated control line from the surface which actuates a lock-out piston and cylinder assembly with a locking mechanism. Once the subsurface valve has been locked out, the lock-out is permanent until the valve is pulled from the well and redressed. In the case of a tubing retrievable subsurface safety valve, this requires pulling the well production string which is time-consuming and expensive.

However, there are instances when it would be desirable to hydraulically lock out a safety valve and hydraulically return the valve back into operation from the surface. Also, there is the possibility in hydraulically locked open safety valves that the lock-out line can be inadvertently actuated which would permanently lock open the safety valve and in that case it would also be desirable to hydraulically reactivate the valve. The present invention is directed to a surface controlled subsurface well safety valve which may be hydraulically locked open from the surface when desired, but which can also be hydraulically returned to normal operation.

SUMMARY

The present invention is directed to a selective hydraulic lock-out subsurface well safety valve having a housing with a bore therethrough, a valve closure element in the bore moving between open and closed positions, a flow tube telescopically movable in the housing for controlling the movement of the valve closure element and biasing means in the housing for biasing the flow tube in a direction for causing the valve closure element to move to the closed position. A first piston and cylinder assembly is positioned in the housing and is adapted to be connected to a hydraulic control line and the first assembly is engagable with the flow tube for opening and closing the valve. A second piston and cylinder assembly in the housing is adapted to be connected to a hydraulic control line and the second assembly is engagable with the flow tube. Lock-out means are connected between the second assembly and the housing for holding the valve in the open position when the second assembly is actuated. A hydraulically actuated release mechanism is engagable with the lock-out means for releasing the lock-out means and allowing the valve to close.

Still a further object of the present invention is a releasable and engagable latch mechanism in the second assembly releasably holding the second assembly from operation thereby preventing operation of the second assembly by hydrostatic forces. But by being releasable and engagable, the latch mechanism may be repeatedly operated hydraulically. In the preferred embodiment, the latch mechanism includes a hydraulic pressure actuated collet and the latch mechanism is hydraulically connected to the second piston and cylinder assembly. Preferably, the latch mechanism includes a collet which is spring-biased to a hold position and is connected to the second assembly and released by predetermined pressure on the second assembly overcoming the spring bias.

Still a further object of the present invention is wherein the hydraulically actuated release mechanism is connected to and actuated by a first piston and cylinder assembly. In the preferred embodiment, the release mechanism includes a ring engagable by a movable shoulder on the first assembly. In addition, the lock-out means includes coacting engaging means on the second assembly and on the housing and the release mechanism engages and controls the engaging means on the housing. Preferably, the movable shoulder includes first and second shoulders on opposite sides of the ring.

Yet a further object of the present invention is the method of operating a subsurface well safety valve which includes a housing having a bore, a valve closure member therein, a flow tube controlling the valve closure member, a first piston and cylinder assembly engagable with the flow tube and connected to a first control line, a second piston and cylinder assembly engagable with the flow tube and connected to a second control line, coacting lock-out engaging means on the second assembly and the housing and a hydraulically actuated release mechanism engagable with the lock-out means. The method includes hydraulically actuating the second assembly while venting the first assembly for locking the valve in the open position and hydraulically actuating the release mechanism by the first assembly while venting the second assembly for releasing the lock-out engaging means and allowing the valve to close. The method further includes releasably retaining the actuation of the second assembly until a predetermined hydraulic force is applied to the second assembly. The method also includes that after releasing the lock-out engaging means, again releasably restraining the actuation of the second assembly. The method also includes biasing the second assembly for overcoming the hydrostatic force acting on the second assembly.

Other and further objects, features and advantages will be apparent from the following description of a presently preferred embodiment of the invention, given for the purpose of disclosure, and taken in conjunction with the accompanying drawings where like character references designate like parts throughout the several views.

DESCRIPTION OF THE PREFERRED EMBODIMENT

Figure 1A:
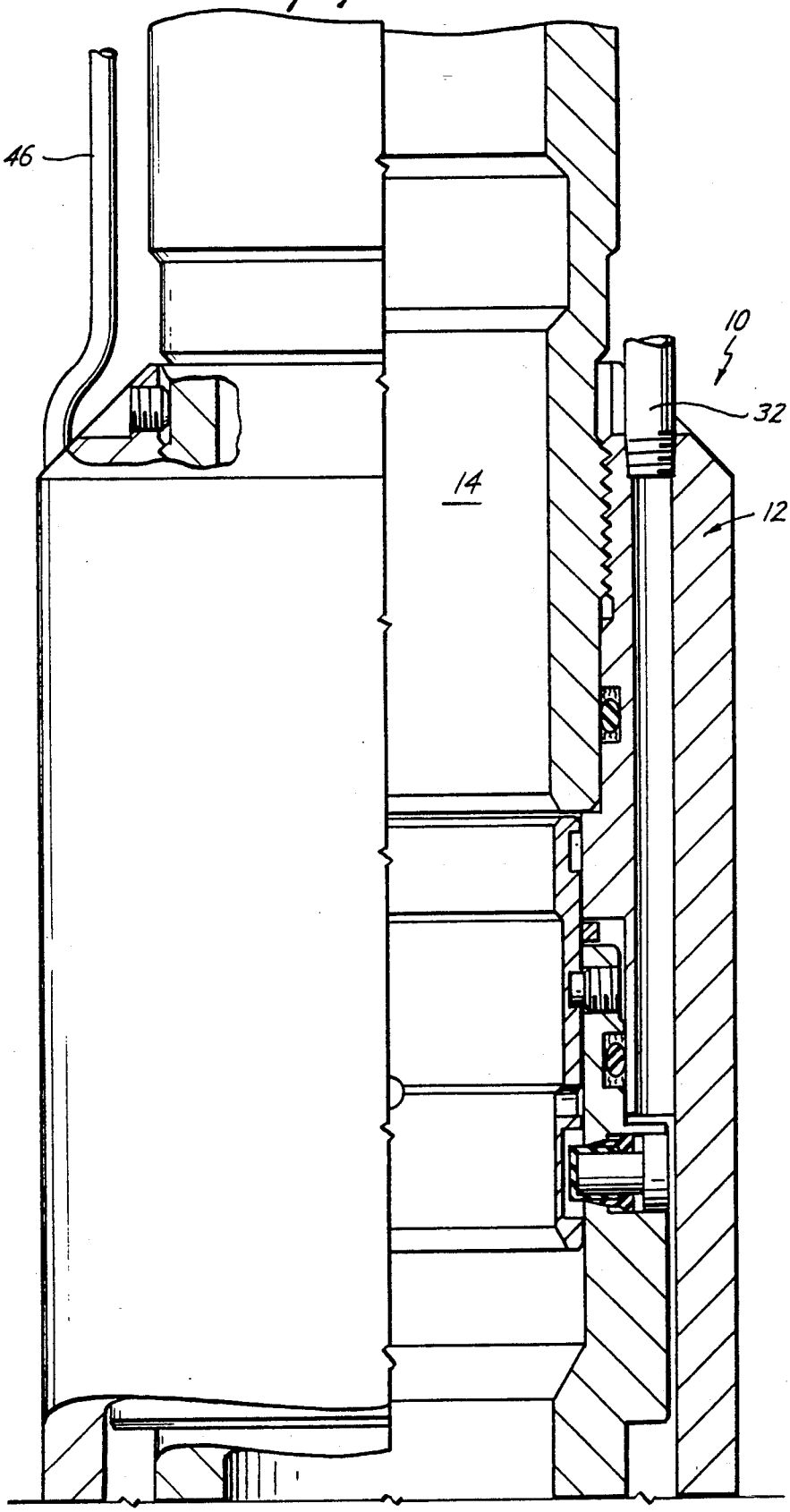
FIGS. 1A, 1B, 1C, 1D, 1E, 1F and 1G are continuations of each other and are a fragmentary elevational in cross section.
Figure 1B:
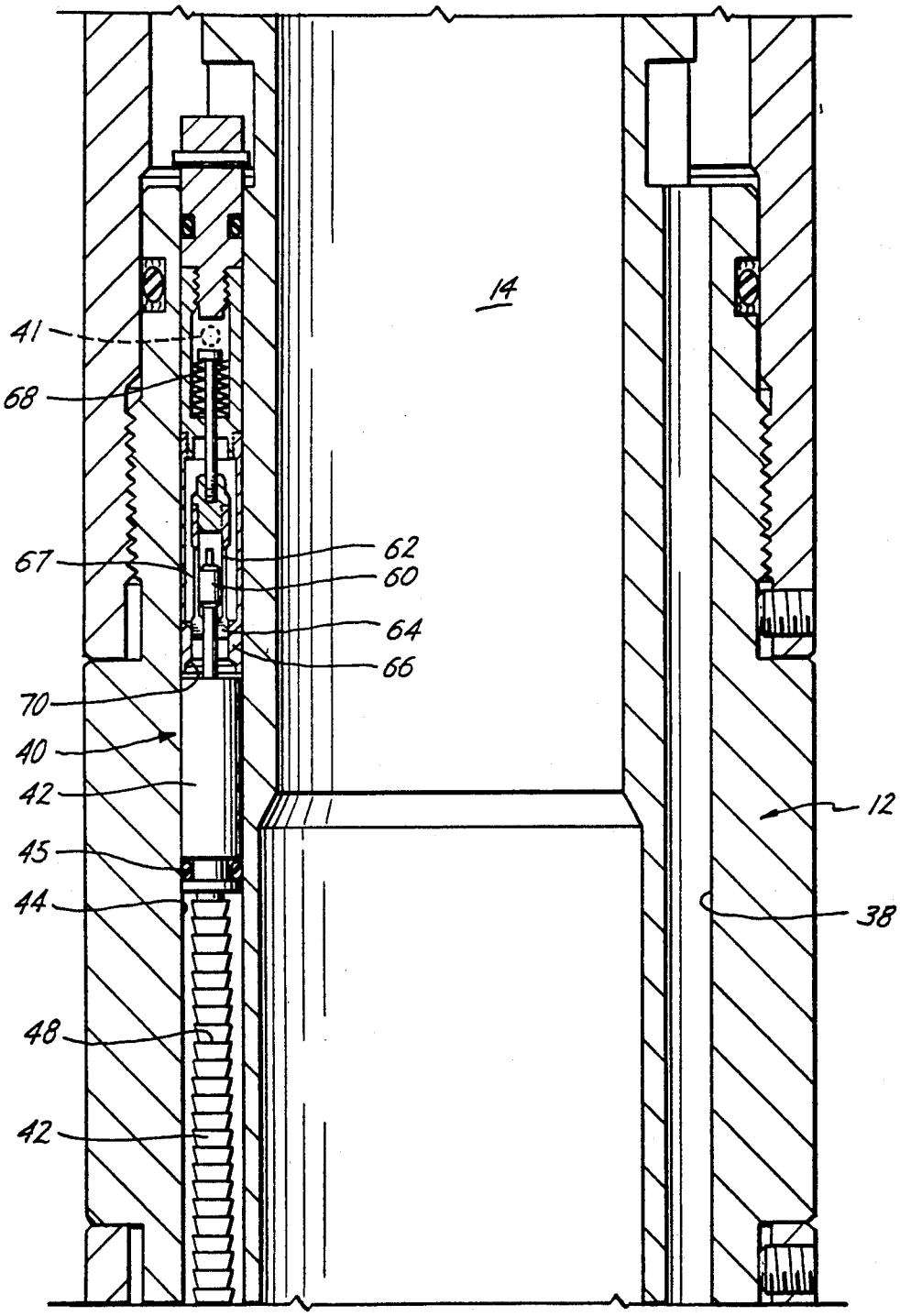

While the present invention will be described in connection with a subsurface tubing safety valve having a flapper type valve closure member for purposes of illustration only, it is understood that the present invention may be used with other types of safety valves, other types of valve closure means, and other types of hydraulic piston and cylinder assemblies.

Referring now to the drawings, particularly to FIGS. 1A–1G, the reference numeral 10 generally indicates a subsurface tubing safety valve of the present invention which includes a body or housing 12 which is adapted to be connected in a well tubing to permit well production therethrough under normal operating conditions, but in which the safety valve 10 may close or be closed in response to abnormal or desired conditions.

The valve 10 includes a bore therethrough 14, an annular valve seat 16 (FIG. 1F) positioned about the bore 14, a valve closure element such as a flapper valve element 18 connected to the body 12 by a pivot pin 20. Thus, when the flapper valve 18 is in the upper position, and seated on the valve seat 16, the safety valve 10 is closed blocking flow upwardly through the bore 14 and well tubing.

A flow tube or longitudinal tubular member 22 is telescopically movable in the body 12 and through the valve seat 16. As best seen in FIG. 1F, when the flow tube 22 is moved to a downward position, the tube 22 pushes the flapper 18 away from the valve seat 16. Thus, the valve 10 is held in the open position so long as the tube 22 is in the downward position. When the tube 22 is moved upwardly, the flapper 18 is allowed to move upwardly onto the seat 16 by the action of a spring 24.

The flow tube 22 is biased in an upward direction by any suitable means such as a gas chamber or a spring 26 (FIG. 1C and 1D) for yieldably urging the flow tube 22 in an upward direction to release the flapper 18 for closing the valve 10. The safety valve 10 is controlled by the application or removal of a pressurized fluid, such as a hydraulic fluid, through a control path or line, such as control line 32, extending to the well surface or the casing annulus which supplies pressurized fluid to a one or more first piston and cylinder assemblies generally indicated by the reference numeral 34 (FIGS. 1C and 2), here shown as two, which includes a piston 36 movable relative to a cylinder 38, one of which, here shown as piston 36, is engaged with or, as shown, is connected to the flow tube 22 through a coupling 37. The safety valve is controlled by the application or removal of pressurized hydraulic fluid through the hydraulic control line 32 to supply and vent hydraulic operating fluid from the piston and cylinder assemblies 34. When pressurized fluid is supplied to the line 32, the flow tube 22 moves downwardly to open the valve 10. When hydraulic fluid is vented from the line 32, the biasing means, including the spring 26, moves the flow tube 22 upwardly to allow the valve 10 to close.

In the event of a failure of the first hydraulic piston and cylinder assembly 34, it may be desirable to provide a lock-out for holding the valve in the open position, or it may be desirable to temporarily lock out the valve 10 for performing workover well operations beneath the safety valve.

Therefore, the present invention is directed to a second piston and cylinder assembly, generally indicated by the reference numeral 40 (FIG. 1B) provided in the housing 12 and includes a piston 42 movable in a cylinder 44. A second hydraulic control line 46 (FIG. 1A) preferably independent from hydraulic control line 32 is provided in fluid communication with the second piston and cylinder assembly through a port 41. Normally, the second piston and cylinder assembly 40 is not connected to the flow tube 22. Instead, the valve 10 is operated from the hydraulic control line 32 acting upon the first piston and cylinder assembly 34. The second assembly 40 is not connected to the flow tube 22, but the lower end 43 of the piston 42 is adapted to engage the flow tube through the coupling 37 to move the flow tube 22 to the open position when the second assembly 40 is actuated.

A lock-out means is provided between the second assembly 40 and the housing 12 for holding the valve 10 in the open position when the second assembly 40 is actuated. The lock-out means may include buttress threaded teeth 48 on the assembly 40 such as on the piston 42 and coacting ratchets 50 carried by the housing 12 and normally urged upwardly by a spring 52 against an incline 54 to urge the ratchet teeth 56 inwardly and into engagement with the buttress teeth 48 when the assembly 40 is actuated.

However, it is desirable that any hydrostatic pressure in the second hydraulic control line 46 be prevented from prematurely actuating the second assembly 40. Therefore, a releasable and engagable latch mechanism is provided in the second assembly 40 which releasably holds the second assembly 40 from operation until a predetermined hydraulic pressure has been applied to the assembly 40, but which after deactuation of the assembly 40 will reengage. Thus, normally the piston 42 is retained from movement by having a head 60 engaged by collet fingers 62 having a shoulder 64 preventing downward movement of the head 60 and thus the piston 42 when the shoulders 64 are backed up by restriction 66. The collet is held in the locking position by spring 68 which may be a plurality of Bellville springs. Therefore, normal hydrostatic pressure flowing in through the port 41 acting upon the piston seal 45 of the piston 42 does not cause actuation of the assembly 40. However, when it is desired to actuate the lock-out assembly 40, increased hydraulic pressure through the port 41 from the control line 46 acting upon the seal 45 moves the piston 42 and the head 60 down against the shoulders 64 overcoming the spring 68 until the shoulders 64 become aligned with a recess 70 below the restriction 66 thereby releasing the head 60 and allowing actuation of the piston 42. The retaining force of the spring 68 can be adjusted to operate at various well depths. Once the piston 42 has been disconnected, the piston 42 will move downwardly and its lower end 43 will engage the coupling 37 moving the flow tube 22 downwardly opening the safety valve 10. The ratchets 50 will engage the buttress head 48 on the piston 42 and lock out the valve 10 in the open position.

However, it may be desirable for various reasons to hydraulically actuate the valve 10 back into its normal operating mode. The present invention is directed to allow the surface controlled subsurface safety valve 10 to be locked open by the dedicated control line 46 from the surface, but thereafter, by hydraulically actuating a release mechanism which is engagable with the lock-out means, the lock-out means is released and the valve 10 is allowed to close and be operated in its normal operating mode through the hydraulic control line 32.

The release mechanism is preferably actuated by the first piston and cylinder assembly 34 and includes a ring 80 (FIG. 1C and 2) which is connected to a sleeve 82 having an opening 84 surrounding the ratchets 54. The sleeve 82 also includes a wedge surface 86 for engaging a coacting wedge surface 88 on the ratchets 50. Therefore, downward movement of the sleeve 82 causes by downward movement of the ring 80 will engage the coacting wedge surfaces 86 and 88 causing the ratchets 50 to be retracted away from the threads 48 and thereby releasing the second assembly 40. A first movable shoulder 90 is positioned on the piston 36 (FIG. 1C) for engaging and moving the ring 80 downwardly along with the sleeve 82 upon opening of the valve 10. A second shoulder 92 is provided connected to the piston 36 for contacting the ring 80, moving the sleeve 82 upwardly, and insuring that the ratchets 50 are free to move inwardly for engagement with the threads 48.

Figure 1C:
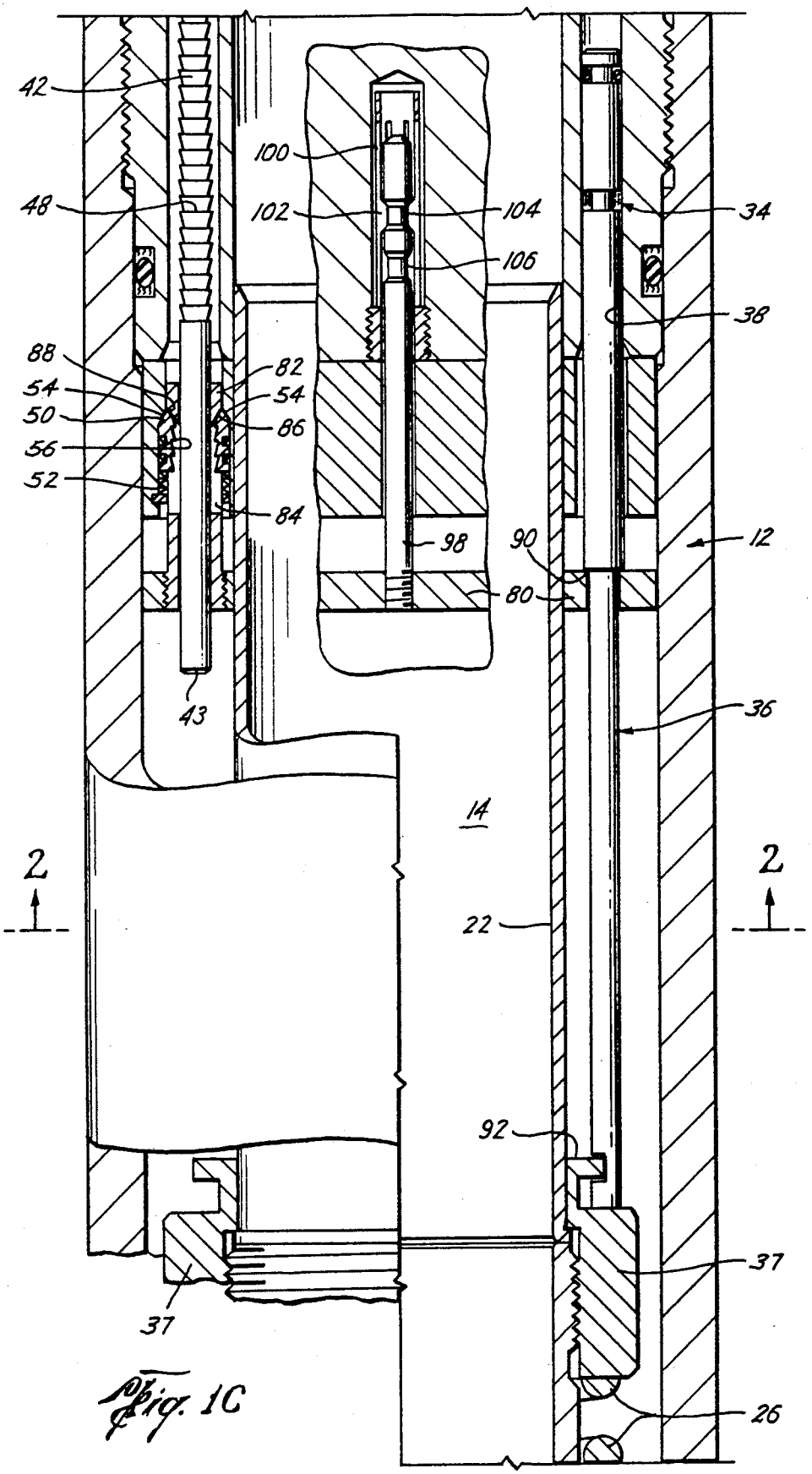
Figure 1D:
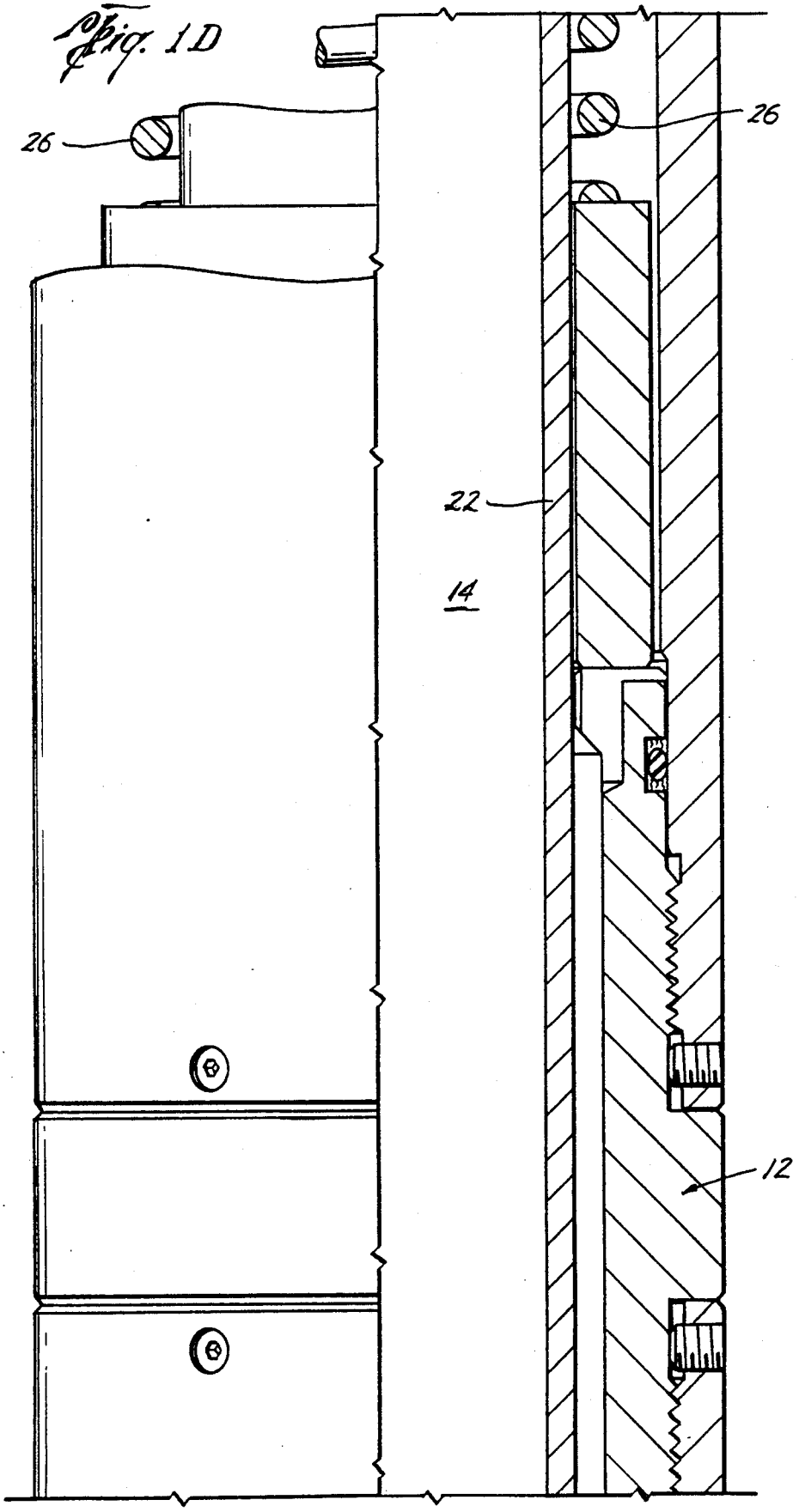
Figure 1E:
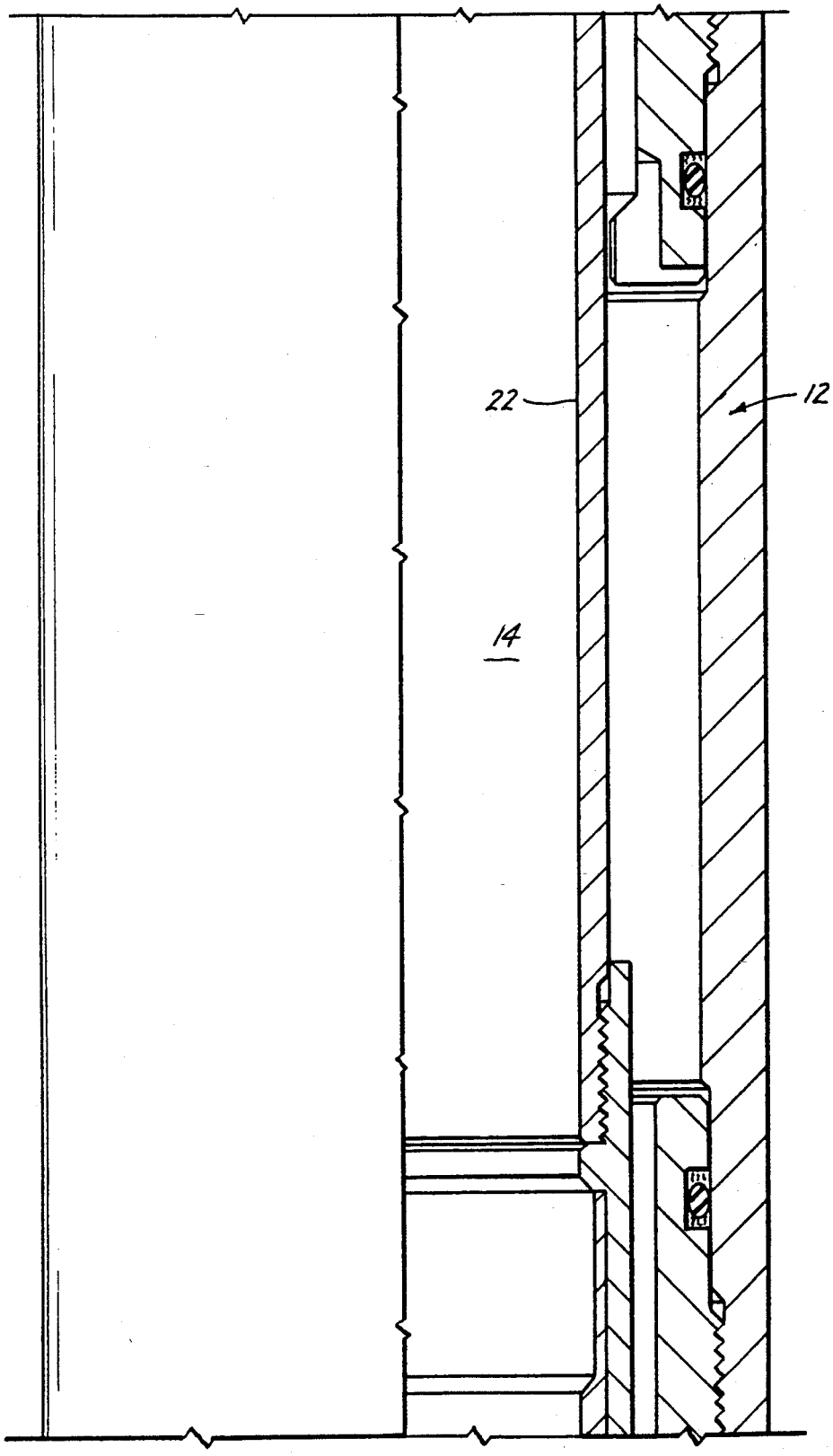
Figure 1F:
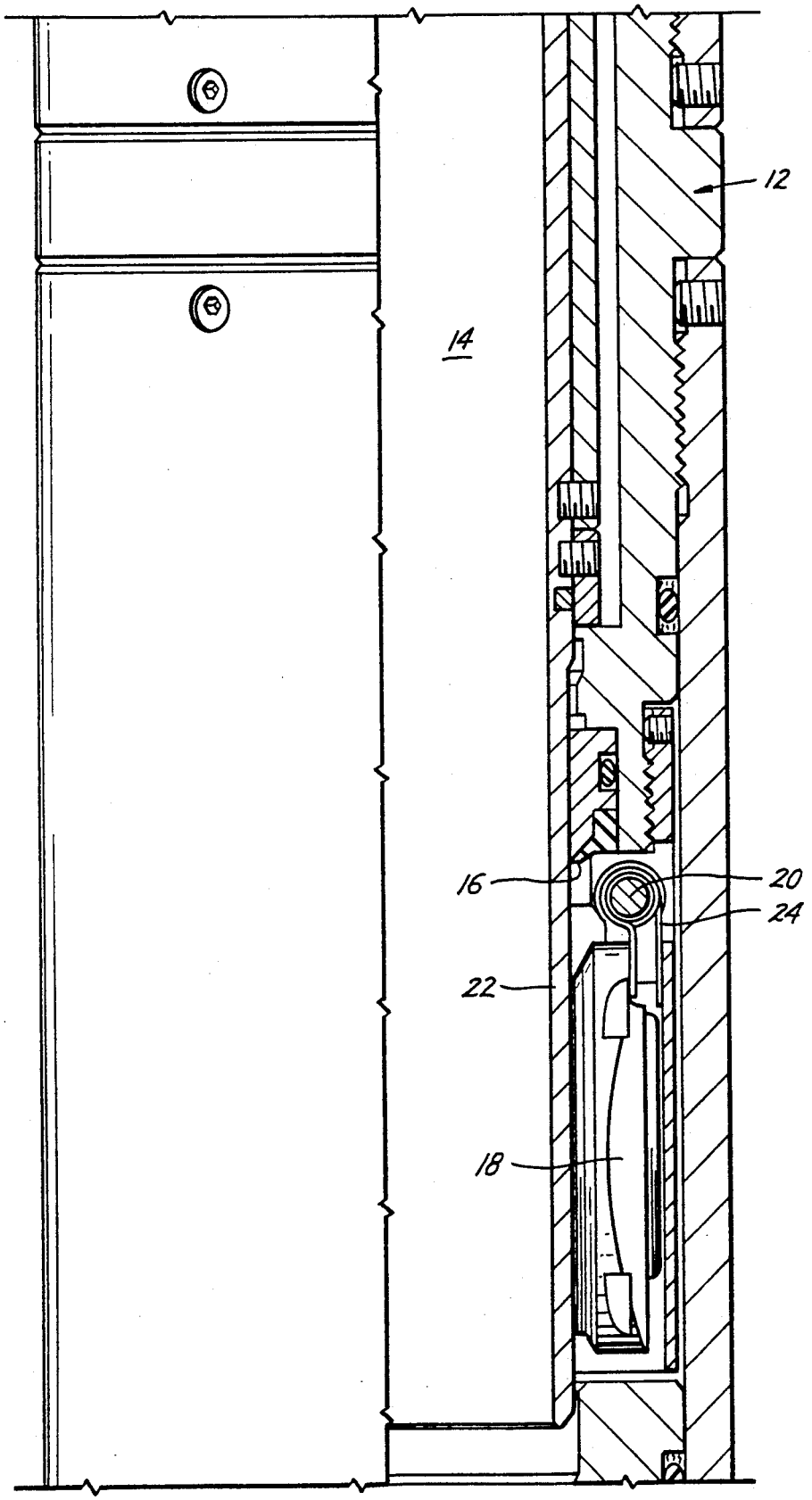
Figure 1G:
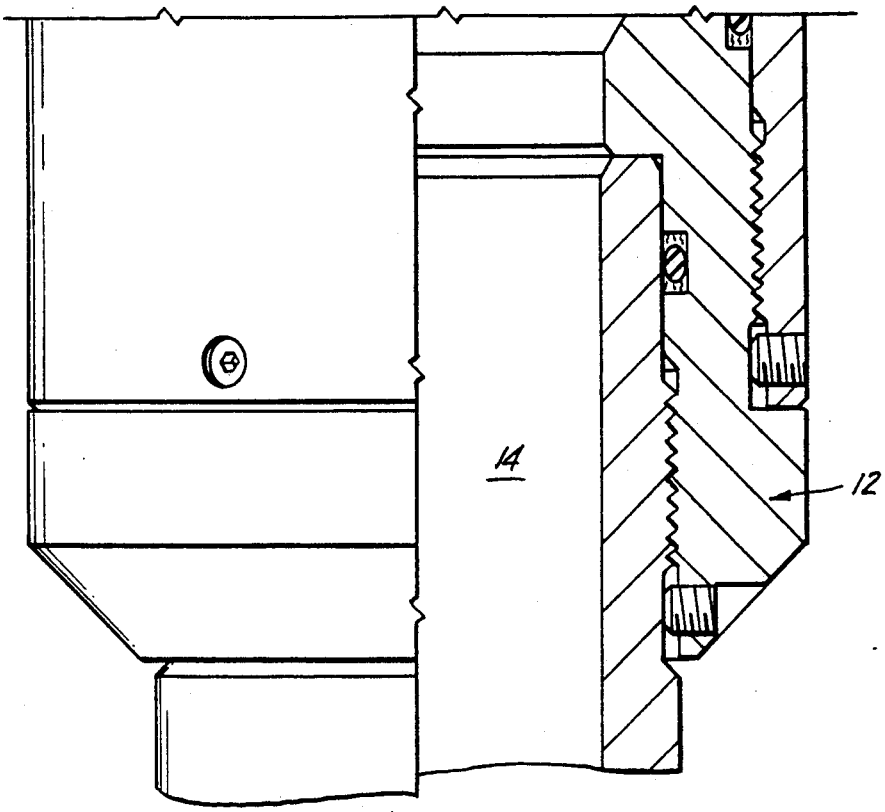
Figure 2:
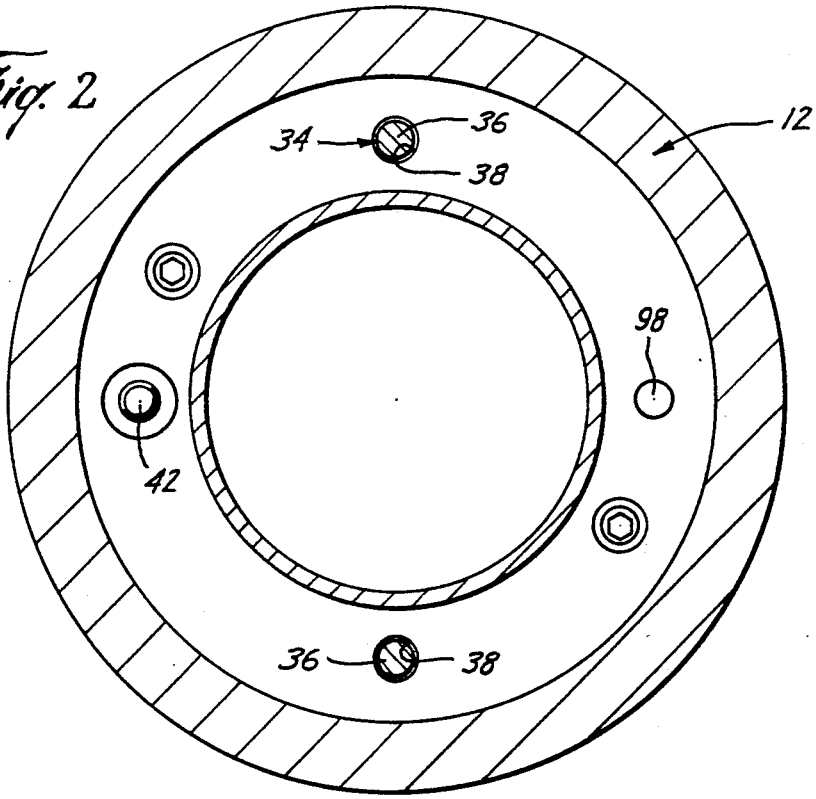
FIG. 2 is a cross-sectional view taken along the line A—A of FIG. 1C.

Referring now to FIG. 1C, preferably a detent rod 98 engaging a collet 100 may be provided if desirable to maintain the ring 80 in either the up or down position as the detent shoulder 102 may engage recesses 104 or 106 on the rod 98.

When the lock-out piston 42 is released, and the hydraulic pressure is bled off of both the first assemblies 34 and the second assembly 40, the pistons 36 and 42 are moved upwardly by the coupling 37 by the action of the power biasing spring means 26. The releasable and engagable latch mechanism in the second assembly 40 will then reengage for future use. That is, the top of the head 60 (FIG. 1B) engages the bottom end of the collet 62 moving it upwardly against the spring 68 until the shoulders 64 move above the restriction 66 and into a recess 67 at which time they would move outwardly allowing them to retrieve and catch the head 60 in the collet 62. The spring 68 will again move the shoulder 64 down into a locking engagement by entering the restriction 66.

In operation, the valve 10 is normally opened and closed by pressurizing and depressurizing the hydraulic fluid leading in the control line 32 to the hydraulic piston and cylinder assemblies 34. In the event that it is desired to hydraulically lock the piston in the open position, the pressure in the control line 46 is increased to the piston and cylinder assembly 40 overcoming the spring 68 and releasing the piston 42 downwardly allowing the ratchets 50 to engage the buttress thread 48 thereby hydraulically locking the valve 10 in the open position. To close the safety valve 10 and return it to normal operating mode, after it has been locked in the open position, the pressure is vented in the control line 46, but applied to control line 32 to the first piston and cylinder assembly 34. When the piston 36 reaches the end of its travel, the shoulder 90 thereon will engage the ring 80, move it downwardly moving the sleeve 82 downwardly which retracts the ratchets 50 and prevent them from engaging the lock-out piston 42. By bleeding the surface pressure in both control lines 32 and 46, the lock-out piston 42 will move upwardly by the action of tubing pressure biasing against the bottom of the seal 45 on the piston 42 and spring 26. The ring 80 will remain in the lowermost position keeping the ratchets 50 in a retracted position by the action of the pin 98 and collet 100. As the flapper 18 closes, and the coupling 37 moves upwardly, it engages the bottom 43 of the piston 42 and resets the releasable and engagable latch mechanism. Therefore, the safety valve 10 is now back in its original mode and can be operated normally by the first piston and cylinder assembly 34.

The present invention, therefore, is well adapted to carry out the objects and attain the ends and advantages mentioned as well as others inherent therein. While a presently preferred embodiment of the invention has been given for the purpose of disclosure, numerous changes in the details of construction, and arrangements of parts, and steps of the method of operation, may be made which will readily suggest themselves to those skilled in the art, and which are encompassed within the spirit of the invention and the scope of the appended claims.

What is claimed is:

1. A selective hydraulic lock-out subsurface well safety valve comprising, a housing having a bore therethrough, a valve closure element in the bore moving between open and closed positions, a flow tube telescopically movable in the housing for controlling the movement of the valve closure element, biasing means in the housing for biasing the flow tube in a direction for causing the valve closure element to move to the closed position, a first piston and cylinder assembly positioned in the housing adapted to be connected to a hydraulic control line, said first assembly engagable with the flow tube, a second piston and cylinder assembly in the housing adapted to be connected to a hydraulic control line, said second assembly engageable with the flow tube, lock-out means between the second assembly and the housing for holding the valve in the open position when the second assembly is actuatued.

a hydraulically actuated release mechanism engagable with the lock-out means for releasing the lock-out means and allowing the valve to close, and a releasable and engagable latch mechanism in the second assembly releasably holding the second assembly from operation.

2. The safety valve of claim 1 wherein the latch mechanism includes a hydraulic pressure actuated collet.

3. The safety valve of claim 1 wherein the latch mechanism is hydraulically connected to the second piston and cylinder assembly.

4. The safety valve of claim 1 wherein the latch mechanism includes a collet, said collet spring biased to a holding position, and connected to said second assembly and released by a predetermined pressure on the second assembly overcoming the spring bias.

5. A selective hydraulic lock-out subsurface well safety valve comprising, a housing having a bore therethrough, a valve closure element in the bore moving between open and closed positions, a flow tube telescopically movable in the housing for controlling the movement of the valve closure element, biasing means in the housing for biasing the flow tube in a direction for causing the valve closure element to move to the closed position, a first piston and cylinder assembly positioned in the housing adapted to be connected to a hydraulic control line, said first assembly engagable with the flow tube, a second piston and cylinder assembly in the housing adapted to be connected to a hydraulic control line, said second assembly engagable with the flow tube, lock-out means between the second assembly and the housing for holding the valve in the open position when the second assembly is actuated, a hydraulically actuated release mechanism engagable with the lock-out means for releasing the lock-out means and allowing the valve to close, and said hydraulically actuated release mechanism is connected to and actuated by the first piston and cylinder assembly.

6. The safety valve of claim 5 wherein the release mechanism includes a ring engagable by a movable shoulder on the first assembly.

7. The safety valve of claim 6 wherein the movable shoulder includes first and second shoulders on opposite sides of the ring.

8. The safety valve of claim 7 wherein the lock-out means includes coacting engaging means on the second assembly and on the housing, and a sleeve connected to the ring and engagable with and controlling the engaging means on the housing.

9. A selective hydraulic lock-out subsurface well safety valve comprising, a housing having a bore therethrough, a valve closure element in the bore moving between open and closed positions, a flow tube telescopically movable in the housing for controlling the movement of the valve closure element, biasing means in the housing for biasing the flow tube in a direction for causing the valve closure element to move to the closed position, a first piston and cylinder assembly positioned in the housing adapted to be connected to a hydraulic control line, said first assembly engagable with the flow tube, a second piston and cylinder assembly in the housing adapted to be connected to a hydraulic control line, said second assembly engagable with the flow tube, lock-out means between the second assembly and the housing for holding the valve in the open position when the second assembly is actuated, a hydraulically actuated release mechanism engagable with the lock-out means for releasing the lock-out means and allowing the valve to close, said lock-out means includes coacting engaging means on the second assembly and on the housing, and said release mechanism engages and controls the engaging means on the housing.

10. A selective hydraulic lock-out subsurface well safety valve comprising, a housing having a bore therethrough, a valve closure element in the bore moving between open and closed positions, a flow tube telescopically movable in the housing for controlling the movement of the valve closure element, biasing means in the housing for biasing the flow tube in a direction for causing the valve closure element to move to the closed position, a first piston and cylinder assembly positioned in the housing and adapted to be connected to a first hydraulic control line, said first assembly engagable with the flow tube, a second piston and cylinder assembly in the housing adapted to be connected to a second hydraulic control line, said second assembly engagable with the flow tube, coacting lock-out means on the second assembly and the housing for holding the valve in the open position when the second assembly is actuated, a hydraulically actuated release mechanism connected to the first assembly and engagable with the lock-out means for releasing the lock-out means and allowing the valve to close, said release mechanism including a ring engagable by first and second spaced shoulders connected to the first assembly and positioned on opposite sides of the ring, and said ring is engagable with and control the engaging means on the housing.

11. The safety valve of claim 10 including, a releasable and engagable latch mechanism in the second assembly releasably holding the second assembly from operation.

12. The method of operating a subsurface well safety valve for controlling the fluid flow through a well conduit in which the valve includes a housing having a bore and a valve closure member moving between open and closed positions, a flow tube telescopically movable in the housing for controlling the movement of the valve closure member, means biasing the tubular member to a closed position, a first piston and cylinder assembly in the housing engagable with the flow tube and connected to a first hydraulic control line, a second piston and cylinder assembly in the housing engaging with the flow tube and connected to a second hydraulic control line, coacting lock-out engaging means on the second assembly and the housing and a hydraulically actuated release mechanism engagable with the lock-out means comprising, hydraulically actuating the second assembly while venting the first assembly and actuating the lock-out engaging means locking the second assembly to the housing for locking the valve in the open position, and hydraulically actuating the release mechanism by the first assembly while venting the second assembly for releasing the lock-out engaging means and allowing the valve to close.

13. The method of operating a subsurface well safety valve for controlling the fluid flow through a well conduit in which the valve includes a housing having a bore and a valve closure member moving between open and closed positions, a flow tube telescopically movable in the housing for controlling the movement of the valve closure member, means biasing the tubular member to a closed position, a first piston and cylinder assembly in the housing engagable with the flow tube and connected to a first hydraulic control line, a second piston and cylinder assembly in the housing engaging with the flow tube and connected to a second hydraulic control line, coacting lock-out engaging means on the second assembly and the housing and a hydraulically actuated release mechanism engagable with the lock-out means comprising, hydraulically actuating the second assembly while venting the first assembly and actuating the lock-out engaging means locking the second assembly to the housing for locking the valve in the open position, hydraulically actuating the release mechanism by the first assembly while venting the second assembly for releasing the lock-out engaging means and allowing the valve to close, and releasably restraining the actuation of the second assembly until a predetermined hydraulic force is applied to the second assembly.

14. The method of claim 13 including, after releasing the lock-out engaging means, again releasably restraining the actuation of the second assembly.

15. The method of claim 13 including, biasing the second assembly for overcoming the hydrostatic force acting on the second assembly.

* * * * *